United States Patent [19]

Jodway

[11] Patent Number: 5,037,106

[45] Date of Patent: Aug. 6, 1991

[54] GAME APPARATUS

[76] Inventor: Nelson L. Jodway, Box 8869, Port Alexander, Ak. 99836

[21] Appl. No.: 533,016

[22] Filed: Jun. 4, 1990

[51] Int. Cl.[5] ..... A63F 3/06

[52] U.S. Cl. ..... 273/239; 273/269; 273/284

[58] Field of Search ..... 273/282 A, 239, 1 GB, 273/269, 271, 265, 268, 284

[56] References Cited

U.S. PATENT DOCUMENTS

| | | | |
|---|---|---|---|
| 715,794 | 12/1902 | Haskell | 273/284 |
| 716,435 | 12/1902 | Lackner | 273/287 |
| 3,549,150 | 12/1970 | Weeks | 273/269 |
| 3,924,852 | 12/1975 | Tamol | 273/1 GB |
| 4,018,445 | 4/1977 | Anania | 273/282 A |
| 4,861,039 | 8/1989 | Phillips et al. | 273/239 |

*Primary Examiner*—Benjamin Layno
*Attorney, Agent, or Firm*—Leon Gilden

[57] ABSTRACT

An apparatus including a predetermined number of bar magnets selectively positionable upon a game board, wherein the game board is formed with a predetermined number of spaces equal to the predetermined number of magnets, wherein in timed sequential turns, each player attempts to position all of that players bar magnets upon the game board without upsetting an adjacent bar magnet. The game object is to permit a winning player to discard all of the winner's bar magnets. The game board includes a matrix of variously colored squares in conformity with a like number of variously colored positions of a spinner. The game board is provided and formed of a transparent material overlying a transparent support floor to permit visual observation of magnetic filings captured within an upper cavity of the housing to indicate orientation of the bar magnets and the bar magnets magnetic influence in attempting to assist individuals in ascertaining positioning of bar magnets upon the game board.

8 Claims, 6 Drawing Sheets

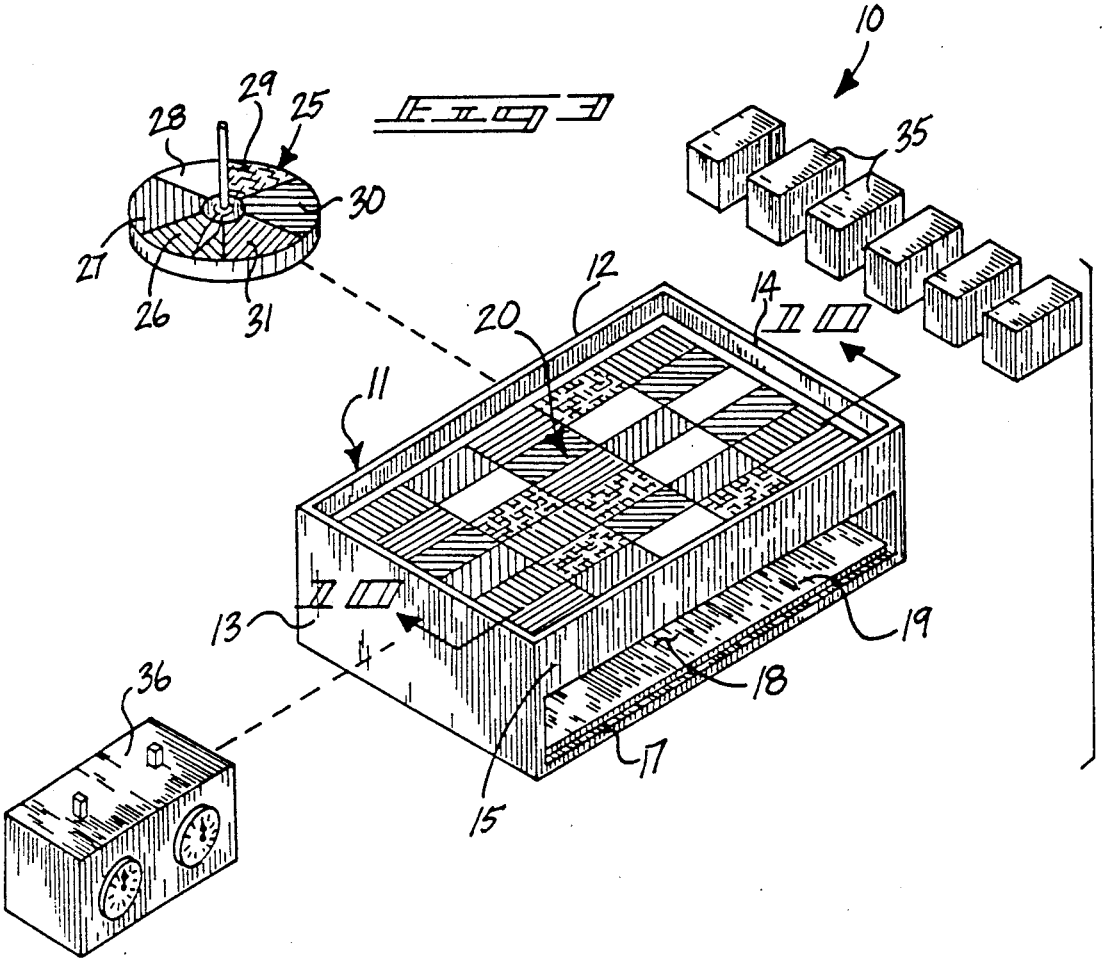
FIG 3
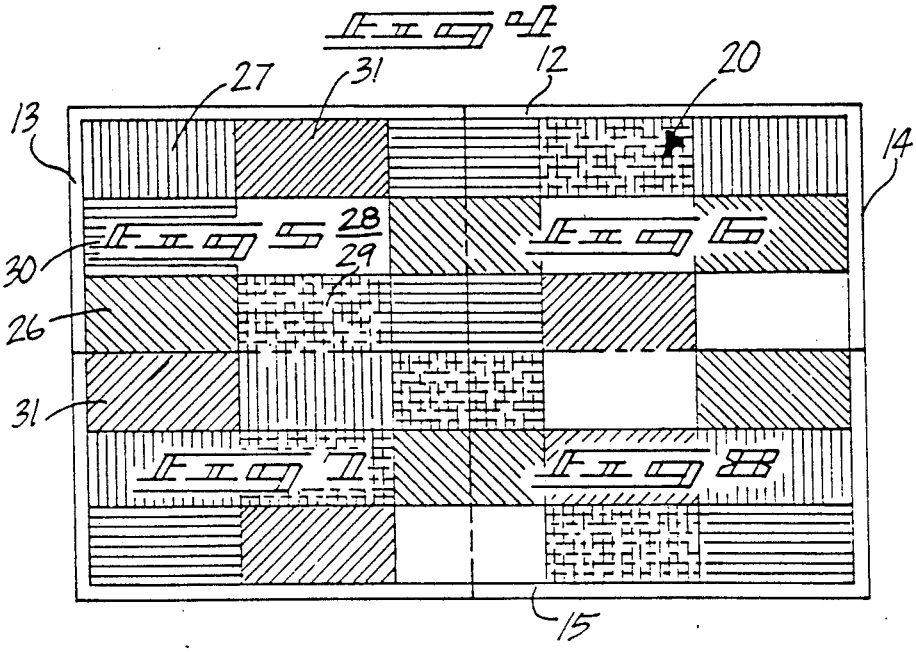
FIG 4
FIG 5
FIG 6
FIG 7
FIG 8

GAME APPARATUS

BACKGROUND OF THE INVENTION

1. Field of the Invention

The field of invention relates to games, and particularly pertains to a new and improved game apparatus whereupon a goal is to afford a player to discard all of that player's magnets upon an associated game board.

2. Description of the Prior Art

Games and games employing magnetic apparatus of various types have been utilized in the prior art to enhance enjoyment and entertainment in the manipulation and deployment of various components of game apparatus. The instant invention sets forth a game apparatus to provide entertainment and enhance eye and hand coordination in the positioning and manipulation of various magnet components about a game board. Examples of prior art game apparatus may be found in U.S. Pat. No. 4,022,474 to Breslow setting forth a game apparatus wherein an elevated playing surface of a housing distributes magnetic pieces therefrom to underlying surfaces to either eliminate players or award players various achievements.

U.S. Pat. No. 4,462,596 to Yamamato sets forth a magnetic game for stacking various magnetic components within slots within a housing to effect mutual attraction and repulsion of various magnetic components within the housing.

U.S. Pat. No. 4,544,282 to Giraldez provides a pendulum formed with symmetrical posts employing fixed magnets to effect pivotment of the pendulum in use.

U.S. Pat. No. 3,799,548 to Lemkin sets forth a magnetic game utilizing various magnetic posts extending exteriorly from each side of a central game board for securement of various "U" shaped game pieces thereon.

As such, it may be appreciated that there continues to be a need for a new and improved game apparatus wherein the same utilizes magnetic game pieces to enhance skill and dexterity of individuals while effecting amusement and entertainment of the individuals during play of the game.

SUMMARY OF THE INVENTION

In view of the foregoing disadvantages inherent in the known types of game apparatus now present in the prior art, the present invention provides a game apparatus wherein the same utilizes magnets positionable about a game board to attempt to dispose of all magnets by a player in an attempt to effect winning of the game. As such, the general purpose of the present invention, which will be described subsequently in greater detail, is to provide a new and improved game apparatus which has all the advantages of the prior art game apparatus and none of the disadvantages.

To attain this, the present invention provides an apparatus including a predetermined number of bar magnets selectively positionable upon a game board, wherein the game board is formed with a predetermined number of spaces equal to the predetermined number of magnets, wherein in timed sequential turns, each player attempts to position all of that players bar magnets upon the game board without upsetting an adjacent bar magnet. The game object is to permit a winning player to discard all of the winner's bar magnets. The game board includes a matrix of variously colored squares in conformity with a like number of variously colored positions of a spinner. The game board is provided and formed of a transparent material overlying a transparent support floor to permit visual observation of magnetic filings captured within an upper cavity of the housing to indicate orientation of the bar magnets and the bar magnets magnetic influence in attempting to assist individuals in ascertaining positioning of bar magnets upon the game board.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game apparatus which has all the advantages of the prior art game apparatus and none of the disadvantages.

It is another object of the present invention to provide a new and improved game apparatus which may be easily and efficiently manufactured and marketed.

It is a further object of the present invention to provide a new and improved game apparatus which is of a durable and reliable construction.

An even further object of the present invention is to provide a new and improved game apparatus which is susceptible of a low cost of manufacture with regard to both materials and labor, and which accordingly is then susceptible of low prices of sale to the consuming public, thereby making such game apparatus economically available to the buying public.

Still yet another object of the present invention is to provide a new and improved game apparatus which provides in the apparatuses and methods of the prior art some of the advantages thereof, while simultaneously overcoming some of the disadvantages normally associated therewith.

Still another object of the present invention is to provide a new and improved game apparatus wherein the same permits players to deploy various magnetic bars throughout a game board surface, wherein the magnets are formed with removable magnetic faces to vary the pole attraction and repulsion of adjacent magnetic bars on the game board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an orthographic top view of the game board of the instant invention diagrammatically sectioned.

DESCRIPTION OF THE PREFERRED EMBODIMENT

Figure 1:
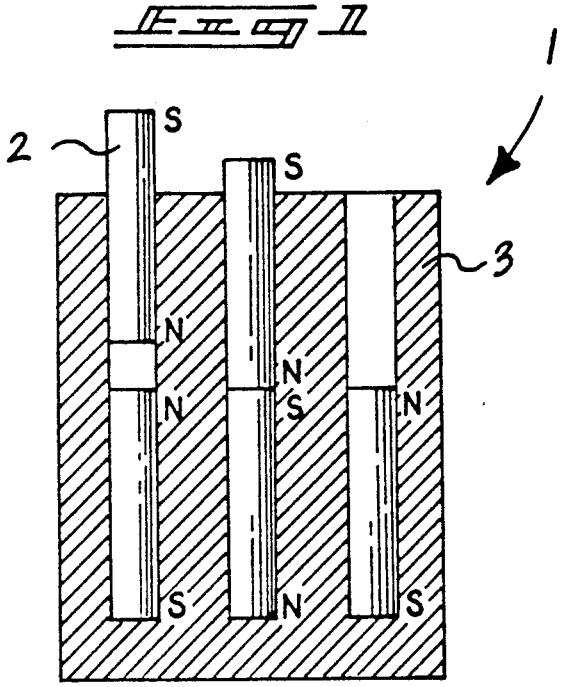
FIG. 1 is an orthographic cross-sectional view of a prior art magnetic game apparatus.

With reference now to the drawings, and in particular to FIGS. 1 to 11 thereof, a new and improved game apparatus embodying the principles and concepts of the present invention and generally designated by the reference numeral 10 will be described.

Figure 2:
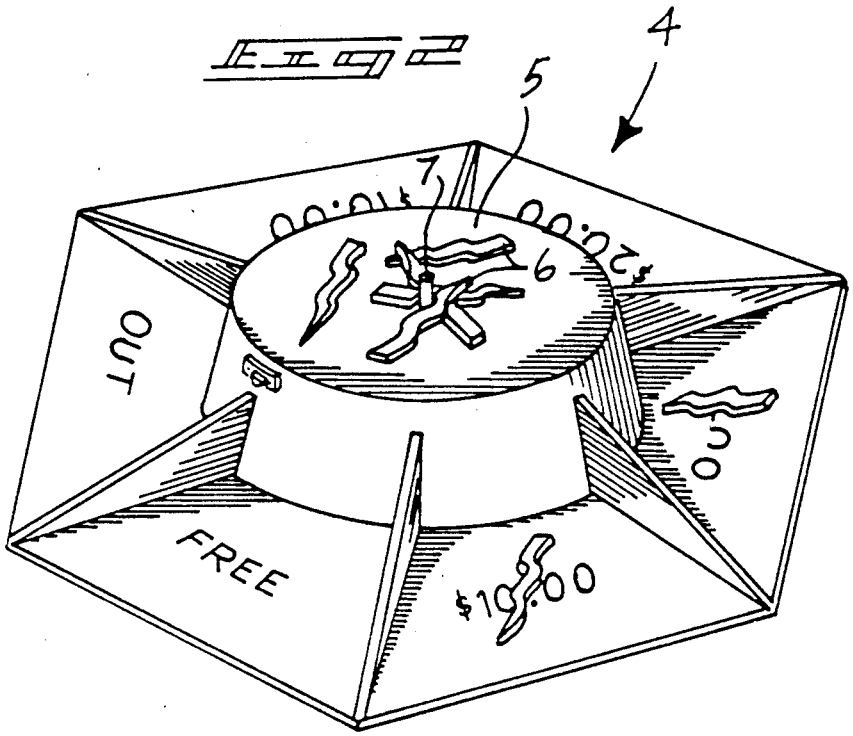
PRIOR ART Fig 2
FIG. 2 is an isometric illustration of a prior art game apparatus utilizing magnetic components.
Figure 5:
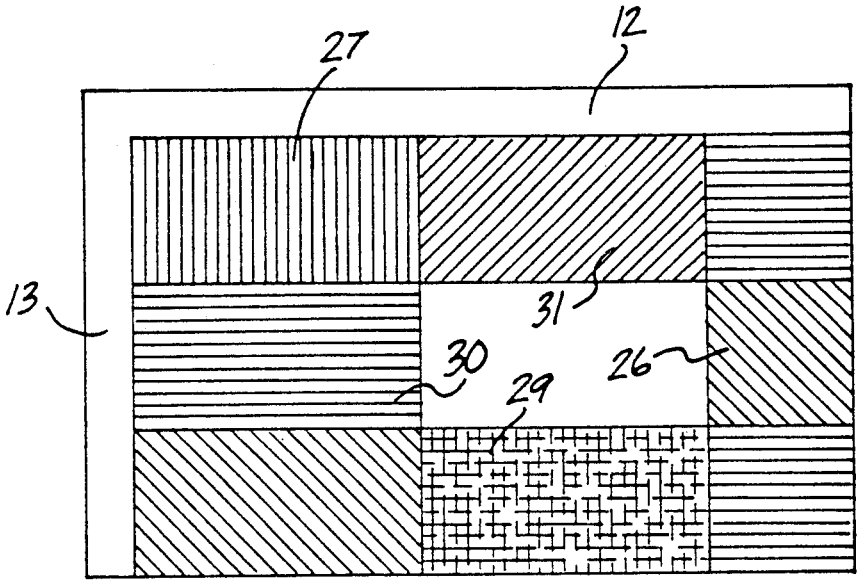
FIG. 5 is a top orthographic view of section 5 as set forth in FIG. 4.
Figure 6:
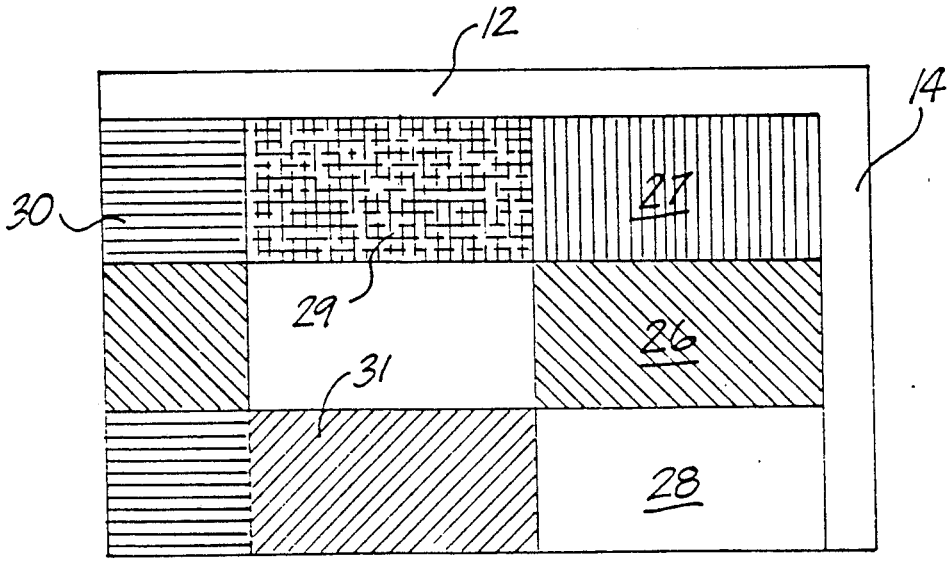
FIG. 6 is an orthographic top view of section 6 as set forth in FIG. 4.
Figure 7:
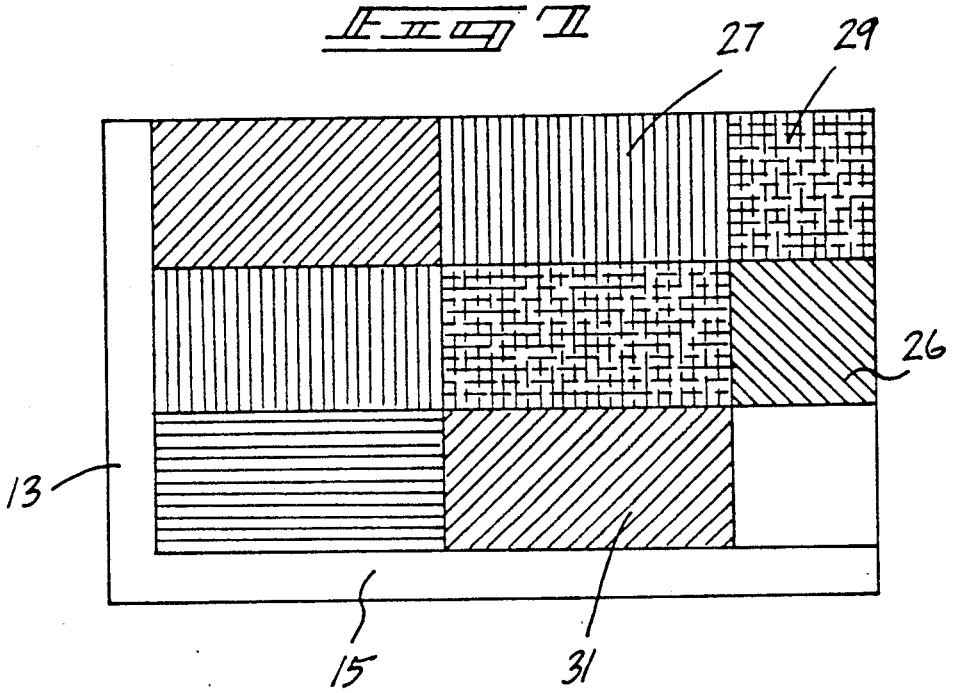
FIG. 7 is an orthographic top view of section 7 as set forth in FIG. 4.
Figure 8:
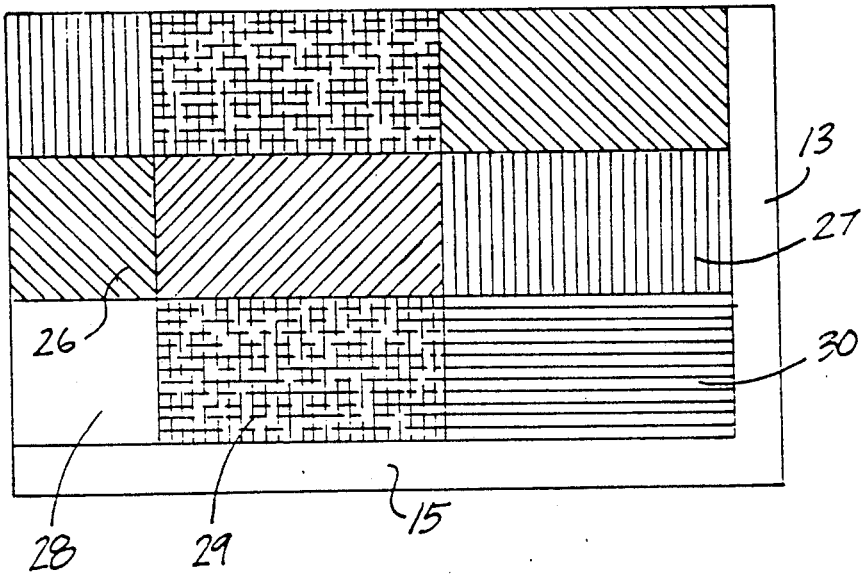
FIG. 8 is an orthographic top view of section 8 as set forth in FIG. 4.
Figure 9:
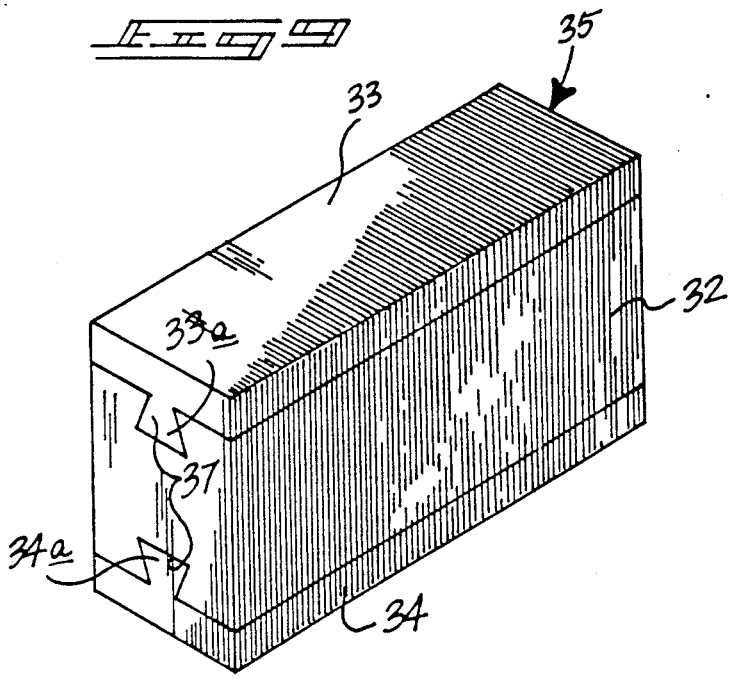
FIG. 9 is an isometric illustration of a typical bar magnet utilized by the instant invention.
Figure 10:
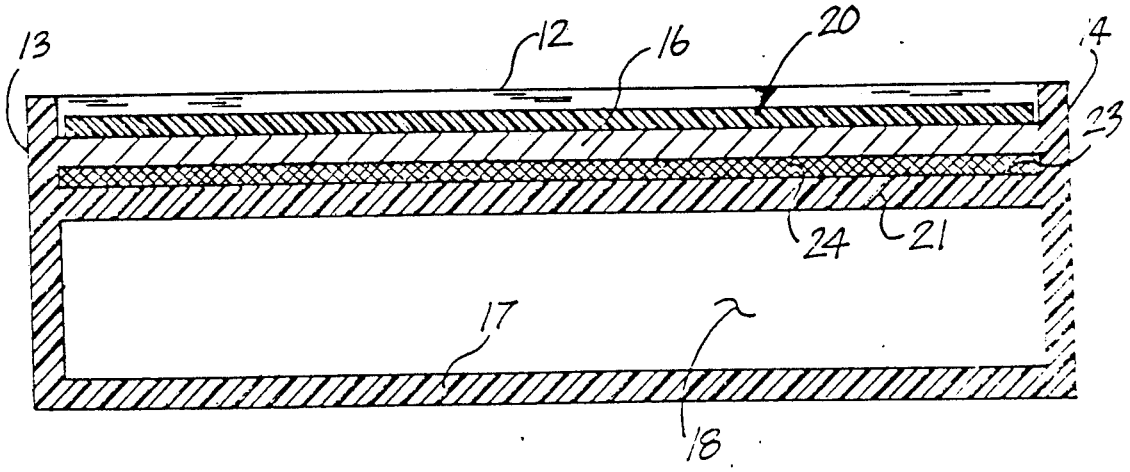
FIG. 10 is an orthographic view, taken along the lines 10—10 of FIG. 3 in the direction indicated by the arrows.
Figure 11:
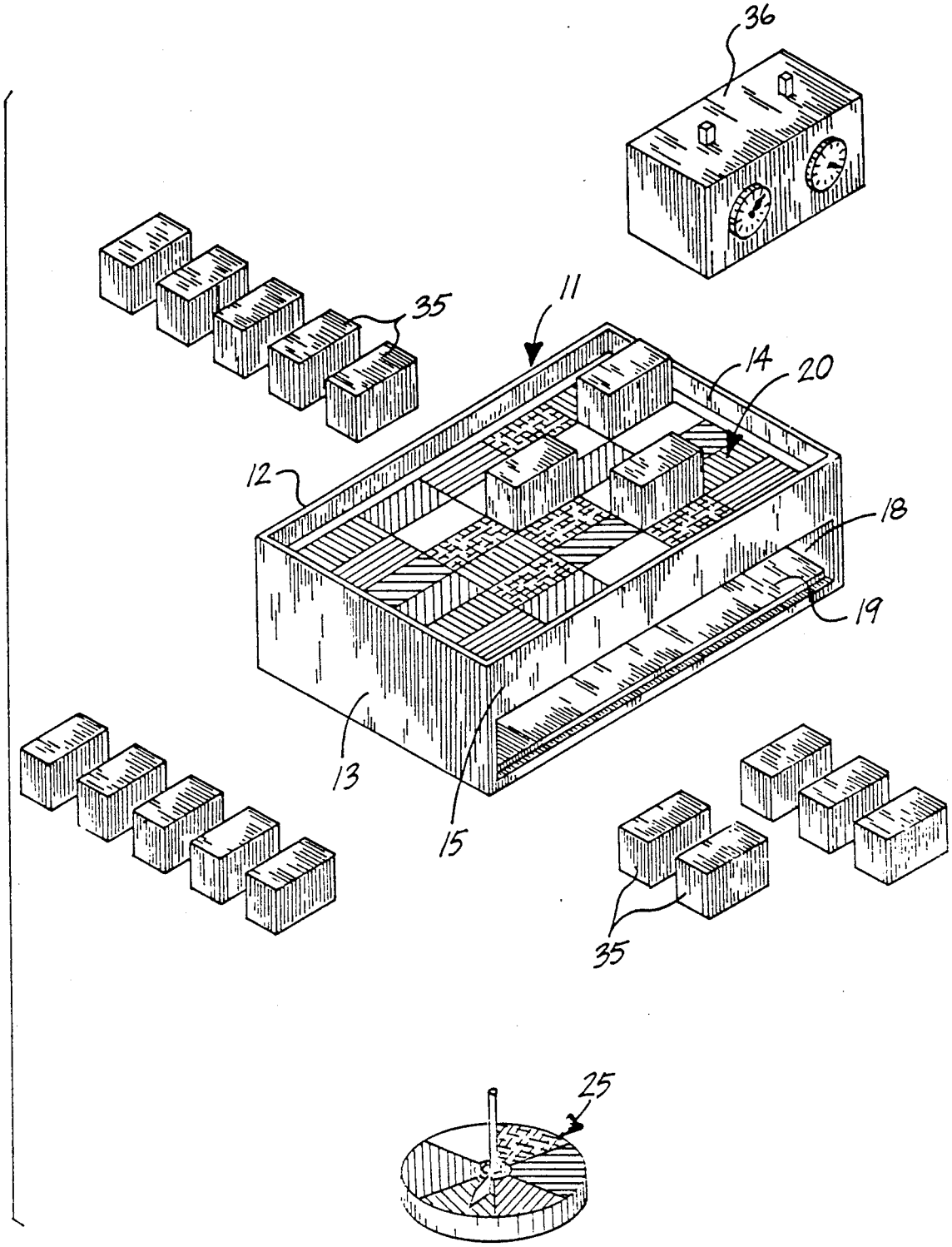
FIG. 11 is an isometric illustration of the game apparatus employing bar magnets in a tipped orientation upon the game board.

FIG. 1 illustrates a prior art game apparatus 1, wherein a housing 3 is a series of slots to receive bar magnets 2 therewithin in a predetermined array and relationship dependent upon the polar alignment of the various magnetic bars 2 positioned therewithin. FIG. 2 illustrates a further prior art magnetic game apparatus 4, wherein an elevated playing surface 5 receives an array of magnetic elements 6, whereupon a spinning magnetic pole 7 directs the magnetic elements 6 to a surrounding lower playing surface awarding various point totals and directions to the players.

More specifically, the game apparatus 10 of the instant invention essentially comprises a central housing 11, including a rear wall 12, a left side wall 13, a right side wall 14, and a forward side wall 15 spaced above a transparent card support floor 16 (see FIG. 10) supporting a playing card 20 thereon. The recessed planar and transparent card support floor 16 overlies an opaque storage cavity roof 21 defining an upper cavity 23 receiving a predetermined quantity of iron filings therewithin visible for viewing through the transparent floor 16 and the associated transparent playing card 20. A storage cavity 18 underlying the cavity roof 21 and an associated housing floor 17 receives a further predetermined number of stored playing cards 19, also of a rather transparent or translucent configuration. The iron filings 24 are utilized to enhance positioning and entertainment of the various magnetic bars 35 positioned upon the card 20 that is also of a translucent, or as noted, transparent nature. The magnetic bars 35 are typically of a predetermined number, such as thirty, and are equally divided among the players participating in the game. Each player is sequentially directed to operate a dual station timer 36 to effect initiation of a time sequence, whereupon the player spins the spinner 25 and directs the indicator of the spinner 25 into one of a plurality of colorations. The colorations include a first, second, third, fourth, fifth, and sixth coloration 26–31 inclusively. The colorations correspond to associated colorations squares upon the playing card 20. Accordingly, each player is directed within the predetermined time interval directed by the timer 36 to position a bar magnet thereon. The object of the game is to position the bar magnet in a typically vertical orientation to prevent tippage of an associated bar magnet per an opposing player. Should such tippage occur, the causing player effecting the tippage will thereupon remove the tipped bar magnet and add to his bar magnet supply. The first player to dispose of all bar magnets is afforded a winning position in the game. Further, should a player not culminate positioning of a bar magnet 35 upon an appropriate coloration space within the game board 20 within the aforenoted predetermined time, each player then awards the moving player a bar magnet as a penalty. It is understood, however, that such magnetic award may not be permitted to allow a player to remove a remaining or last bar magnet from his supply to be declared a winner, only an active manipulation of that remaining bar magnet upon the game board 20 in an appropriate coloration space is permitted.

Each bar magnet (see FIG. 9) is formed with a central body 32, wherein the body includes opposed side faces, including a dovetail slot 37 formed coextensively through each face, wherein the opposed dovetail faces of the opposing faces of the central body 32 are parallel to and generally coextensive relative to one another. Each dovetail slot 37 receives an associated first and second dovetail **33*a* and 34*a* respectively, wherein each respective first and second dovetail are formed to a respective first and second sliding top and bottom magnetic plate 33 and 34. The magnetic plates 33 and 34 may be of a like polar magnetic attraction, i.e. North and North or South and South, but may be of differing magnetic attraction, such as North and South, to effect confusion of opposing players. Accordingly within the stored playing cards 19**, an opaque playing card rather than a translucent playing card may be utilized to prevent players from viewing the orientation of the magnetic filings upon positioning of a bar magnet thereon to enhance an element of chance associated with positioning of a bar magnet upon a playing card.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game apparatus comprising, in combination, a central housing, the central housing including a rear wall, a left side wall, a right side wall, and forward wall and a card support floor, and a playing card mounted upon the card support floor between the rear wall, left side wall, right side wall, and forward wall, the card support floor recessed below the rear wall, left side wall, right side wall, and forward wall, and including a spinner mechanism, the spinner mechanism including a predetermined number of colorations associated with the spinner mechanism to effect indication of one of said colorations, and the playing card including a matrix of the predetermined colorations directed throughout an upper surface of the playing card defining a plurality of spaces, and further predetermined number of bar magnets, the bar magnets arranged for positioning upon each of the spaces, and the playing card including a further predetermined number of spaces equal to the further predetermined number of bar magnets, and a timer mechanism to effect a timed interval for a player to position a bar magnet of the further predetermined number of bar magnets upon one of said further predetermined number of spaces, and wherein the card support floor is transparent, and the card support floor is spaced above and coextensively overlying an opaque storage cavity roof defining an upper cavity therebetween, with a quantity of iron filings directed throughout the upper cavity, and the iron filings indicating orientation of magnetic fields directed by the bar magnets of the further predetermined number of bar magnets.

2. A game apparatus as set forth in claim 1 wherein the playing card is transparent.

3. A game apparatus as set forth in claim 1 including a further playing card, wherein the further playing card is opaque.

4. A game apparatus as set forth in claim 3 wherein the central housing further includes a housing floor underlying the storage cavity roof, and the housing floor defining a storage cavity between the storage cavity roof and the housing floor to receive the further playing card therewithin.

5. A game apparatus as set forth in claim 4 wherein each bar magnet includes a central body, the central body including an upper and lower surface, the upper surface including a first dovetail slot, and the lower surface including a second dovetail slot, wherein the first and second dovetail slots are coextensive with and parallel to one another in an aligned relationship.

6. A game apparatus as set forth in claim 5 wherein each bar magnet further includes a first sliding magnetic plate and a second sliding magnetic plate, wherein the first and second magnetic plates each include a respective first and second dovetail integrally mounted thereto, wherein the first and second dovetails are complementarily received within the first and second dovetail slots.

7. A game apparatus as set forth in claim 6 wherein the first and second magnetic plates are of differing magnetic polar magnetism.

8. A game apparatus as set forth in claim 6 wherein the first and second magnetic plates are of the same polar magnetism.

* * * * *